US007824200B2

(12) United States Patent
Bryla et al.

(10) Patent No.: US 7,824,200 B2
(45) Date of Patent: Nov. 2, 2010

(54) DATA TRANSFER HINGE

(75) Inventors: Mark Daniel Bryla, Cumming, GA (US); Eriks A Zusmanis, Berkeley Lake, GA (US); Paul Marquis, Wallingford, CT (US)

(73) Assignee: Assa Abloy, Inc., New Haven, CT (US)

( * ) Notice: Subject to any disclaimer, the term of this patent is extended or adjusted under 35 U.S.C. 154(b) by 0 days.

(21) Appl. No.: 12/413,943

(22) Filed: Mar. 30, 2009

(65) Prior Publication Data

US 2010/0243314 A1 Sep. 30, 2010

(51) Int. Cl.
*H01R 39/00* (2006.01)

(52) U.S. Cl. ..... 439/165; 16/223

(58) Field of Classification Search ..... 439/165, 439/31; 16/223

See application file for complete search history.

(56) References Cited

U.S. PATENT DOCUMENTS 4,116,514 A * 9/1978 Lawrence ..... 439/31
4,168,409 A * 9/1979 McNinch ..... 200/61.7
4,412,711 A 11/1983 Suska
4,839,939 A 6/1989 O'Brien, II
5,586,895 A 12/1996 Zehrung
5,727,960 A 3/1998 Zehrung
7,063,042 B2 6/2006 Dillingham
7,110,916 B2 9/2006 Shimonishi
2001/0009499 A1 7/2001 Carlson

OTHER PUBLICATIONS

Product Bulletin, ElectroLynx-Hardwiring Made Easy, McKinney, Jun. 1, 2004.

* cited by examiner

*Primary Examiner*—Gary F. Paumen
(74) *Attorney, Agent, or Firm*—Steven B. Phillips; Moore & Van Allen PLLC

(57) ABSTRACT

A data transfer hinge is disclosed. Embodiments of the present invention provide a door hinge that facilitates transmission of data from LAN wiring in a building through a door frame to a door mounted device. Power and ground connections can also pass through the hinge. Channels run in each leaf from an edge coincident with the knuckles of the leaf to a passageway in the face of the leaf. Twisted pairs of data wires having a specified number of twists per unit length run through the passageway and the channels in the leaves. Each wire of a twisted pair is of a gauge and has insulation of a specified thickness and permittivity so as to cooperate with the channel to maintain an even distribution of capacitance and appropriate impedance for connection within a local area network.

27 Claims, 8 Drawing Sheets

DATA TRANSFER HINGE

BACKGROUND

Local area network (LAN) communications between various systems and devices is ubiquitous. For example, existing electronic infrastructures are commonly outfitted with devices compatible with the Ethernet standards, including those for power-over-Ethernet (PoE), 100 Base-T, 10 Base-T, and other similar protocols. Ethernet interfaces can be found in devices such as IP telephones, wireless LAN access points, network cameras, building automation devices, security devices and the like.

Wired Ethernet data transmission at speeds of 100 megabits per second requires cabling that can sustain a 100-125 MHz bandwidth. Such a bandwidth can be maintained by using differential data transmission and other techniques to minimize interference. An appropriate impedance must be maintained throughout the data transmission path to maintain data integrity. Maintaining such an impedance is typically not a problem with long cables where there are no severe bends or discontinuities, but can be difficult in tight spaces. Where cables must turn or be severely constrained, discontinuities can occur.

SUMMARY

Embodiments of the present invention provide a door hinge that facilitates transmission of data from LAN wiring in a building through a door frame to a door mounted device. In at least some embodiments, power or other signals can also be transmitted through the hinge. In at least some embodiments the door hinge is fast Ethernet capable, having a center frequency of up to 100 MHz so that it can pass 100 Base-T (100 megabits per second) Ethernet signals. The door hinge of embodiments of the invention may be referred to as a "data transfer hinge" and can be made to be compatible with wiring specified in the TIA-EIA-568 telecommunications standard for Ethernet cable.

A data transfer hinge according to at least some embodiments of the invention includes a first leaf and a second leaf, each having at least one knuckle. Each leaf also has at least one channel running from an edge coincident with the knuckle or knuckles to a passageway in a face of the leaf. The passageway opens into the channel. As is typical with door hinges, the knuckle or knuckles of the first leaf and the knuckle or knuckles of the second leaf are arranged to be relatively rotatable around a common axis in accordance with the normal functioning of a hinge. A twisted pair of data wires having a specified number of twists per unit length runs through the passageway in the face of each leaf and through the channel in both the first leaf and the second leaf. A pin or pins with a void can be used to pass the wires from one hinge leaf to another. Additional spacers may be used to pass wires into and out of the pin. Each wire of the twisted pair of data wires is of a gauge and has insulation of a specified thickness and permittivity so as to cooperate with the channel in the hinge leaves to maintain an even distribution of capacitance and appropriate impedance for connection within a local area network.

In at least some embodiments, for example, for use in Ethernet systems, there are two channels machined into each leaf for differentially driven wiring, one for each of two twisted pairs of data wires. In some embodiments, both of two twisted pairs of data wires run through a single channel. An additional passageway on the face of each leaf and additional channels can also be provided for additional wires. Alternatively, the additional wires can be run through the same channel as one or more of the twisted pairs of data wires. In example embodiments, these additional wires can be straight wires, as opposed to twisted pairs, and can be used for power, ground, or other purposes for which high data transfer rates are not needed. Connectors can be provided at the ends of all wires to connect the hinge to a door frame harness assembly that in turn is connected to building wiring, as well as to a door-mounted device, possibly through a door harness assembly. Shielding may be provided for the twisted pairs of wiring that run from the passageways in the leaves to the connectors.

In at least some embodiments a number of twists per unit length for the twisted pairs of data wires is about 1.5 twists per inch. In some embodiments, the gauge of the data wires is 26AWG and a channel is machined by boring with a 2 millimeter bit. In some embodiments, a channel can be machined by forming a slot using electrical discharge machining. In some embodiments, the specified thickness of the insulation on the data wires is about 0.006 inches and the permittivity of the insulation on the data wires is about 2.1.

DETAILED DESCRIPTION OF EXAMPLE EMBODIMENTS

The following detailed description of embodiments refers to the accompanying drawings, which illustrate specific embodiments of the invention. Other embodiments having different structures and operation do not depart from the scope of the present invention.

Embodiments of the present invention consist of a hinge with wire runs through machined channels within the hinge leaves. Signal integrity for differential data pairs of wires through their respective channels can be comparable with that specified for the well-known IEEE 802.3 standards for frequencies up to 100 MHz. Signal integrity is maintained by providing coupling twists at a specified number per unit length for each differential data pair of signal wires. The twists induce a current equally and oppositely from one wire of a pair to the other, providing appropriate isolation of data wires to prevent excessive capacitive coupling to ground or between wires.

In example embodiments, insulation of a specified thickness and permittivity coats each wire of the differentially driven, twisted pairs of data wires. This insulation cooperates with the air gap between the wires and the channels to reduce fringe capacitance to ground and to maintain an even distribution of capacitance throughout the data transfer hinge so as not to create an impedance mismatch. In example embodiments, the impedance of the twisted pairs of data wires is 100 ohms at 100 MHz. In some embodiments, the portions of the twisted data pairs of wire between a passageway out of the hinge leaf and the connectors are shielded, for example, by using shielded heat shrink tubing, to further protect signal integrity.

In some environments, power would also be transmitted over the twisted data pairs. However, in some embodiments the data transfer hinge is provided with separate straight through wires for power and ground. In some embodiments, the data transfer hinge has an additional conductor running through the hinge for earth ground to provide for electrostatic discharge (ESD) protection of connected components and/or devices. This ground wire provides a drain from the door-mounted device to prevent ESD voltages from being propagated on the LAN data lines. The data transfer hinge in at least some embodiments can be outfitted using wire insulation colors that match the well-known TIA-EIA-568 standard (either the "A" standard or the "B" standard) for Ethernet LAN wiring. Appropriate connectors can be provided for quick connect termination to mating frame and door wiring harnesses, or the hinge could be supplied without connectors on one or both ends of one or both of the cables, that is, with so-called "flying leads" so that appropriate connectors could be installed in the field. It would also be possible to provide standard LAN connectors, such as RJ-45 Ethernet connectors.

Figure 1:
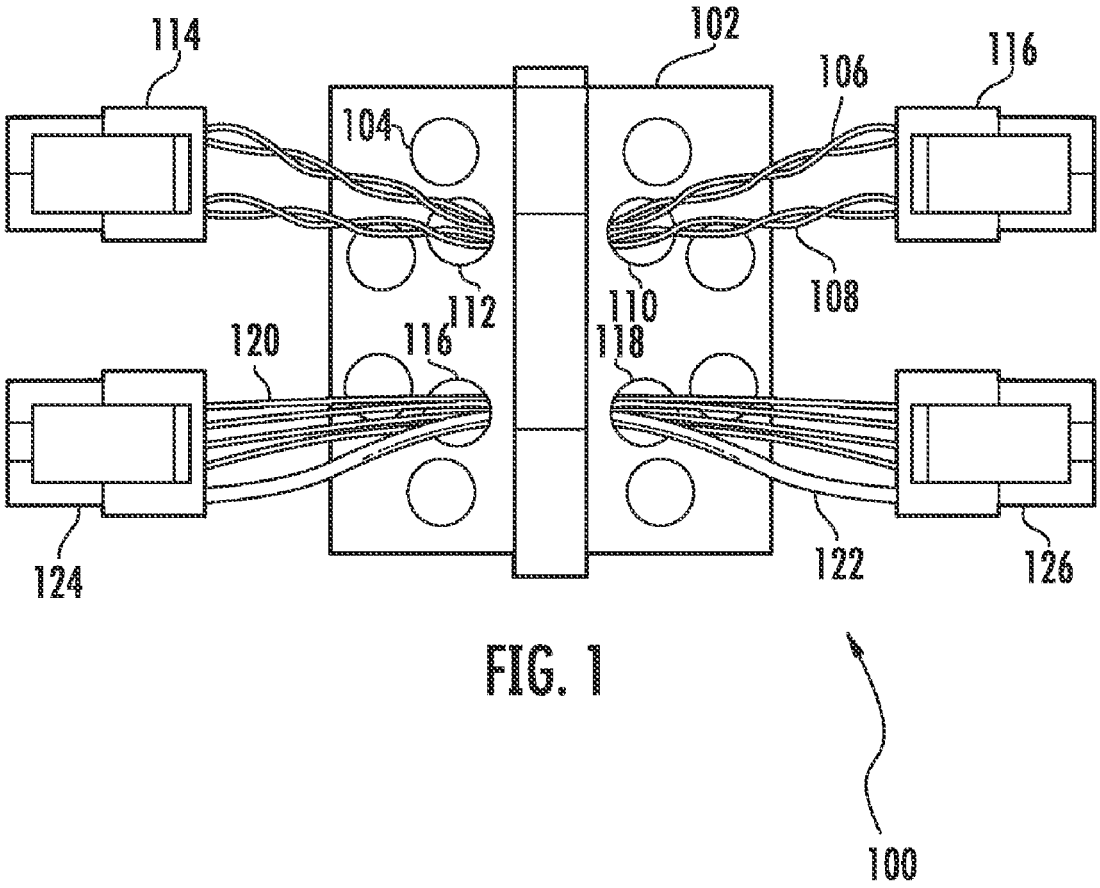
FIG. 1 is a high-level schematic concept diagram of a data transfer hinge according to example embodiments of the invention.

FIG. 1 is a high-level schematic concept diagram of an example embodiment of the data transfer hinge. Data transfer hinge 100 in this example is formed from a metal door hinge 102. Hinge 102 is provided with four screw holes 104 for mounting to a door and door frame. Twisted pairs of data wires 106 and 108 pass through the hinge making use of passageways 110 and 112. Inside the hinge leaves, twisted pairs 106 and 108 each run through a channel in each of the metal leaves of hinge 102 and pass through the knuckle area of hinge 102. Connectors 114 and 116 provide a way to easily connect the twisted pairs to appropriate wiring in the door and door frame.

Still referring to FIG. 1, example data transfer hinge 100 includes another set of passageways, 116 and 118 in the leaves of hinge 102. Four straight wires, exemplified by wire 120, run through the passageways and two of the four straight wires run through each of two additional channels in each of the leaves of hinge 102 and pass through the knuckle area of hinge 102. A ground wire, 122, is also provided and runs through one of the channels. Connectors 124 and 126 provide for connection to appropriate wiring in the door and door frame. The straight wires such as wire 120 can be used for power, ground, or other signals for which the high-bandwidth that the twisted pairs are capable of supporting is not required.

FIGS. 2, 3, 4 and 5 present different views of a detailed illustration of one example embodiment of a data transfer hinge of the invention. Like reference numbers refer to the same structures throughout these figures. The connectors are omitted in this embodiment so that the wires exiting the jacketing leading away from the hinge are more clearly visible. The particular hinge illustrated in these figures is a three-knuckle hinge, although the number of knuckles of the hinge is irrelevant to the inventive principle and the hinge could be one with any other number of knuckles, for example, a five-knuckle hinge.

Figure 2:
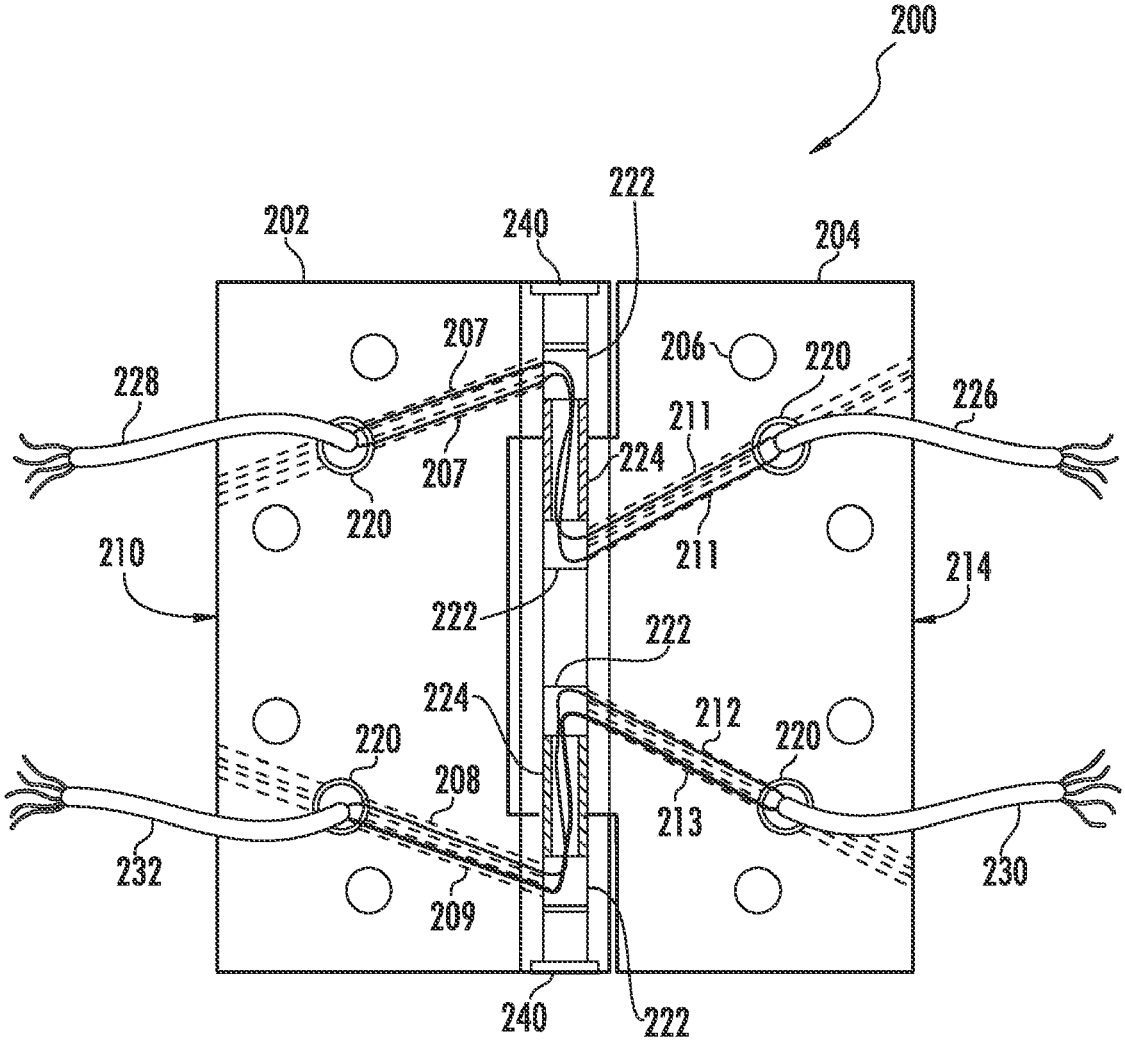
FIGS. 2-5 present a more accurate depiction of an embodiment of the data transfer hinge in various views.

Data transfer hinge 200 as illustrated in FIG. 2 includes first leaf 202 and second leaf 204. For both leaves, the face of the leaf that would not be observable when the hinge is in use, typically referred to as the back of the hinge, is facing the viewer. The visible faces would be screwed down against the door or door frame as the case may be, with screws or other fasteners through multiple identical holes in the leaves, of which hole 206 is an example. As is typical with door hinges, the knuckles of leaf 202 at the top and bottom of the hinge and the knuckle of leaf 204 at the center of the hinge are arranged to be relatively rotatable around a common axis in accordance with the normal functioning of a door hinge. In this example, channels 207, channel 208 and channel 209 have been made from an outer edge 210 of leaf 202 of FIG. 2 to an opposing edge, which is coincident with the knuckle portion of the leaf. Likewise, channels 211, channel 212 and channel 213 have been made from an outer edge 214 of leaf 204 of FIG. 2 to an opposing edge, which is coincident with the knuckle portion of the leaf. The channels, being normally not visible from this view in an actual hinge, are shown with dotted lines. It should be noted that the phrase, "coincident with the knuckle portion" is meant in its broadest sense. The channel can exit the knuckle portion of a leaf in a number of ways. In some hinges, the knuckles and the leaf are made of a single piece of metal, so that all that defines a knuckle is a curved extension of that single piece of metal. In such a case the channel simply exits the leaf at a point in the wall of the knuckle.

Still referring to FIG. 2, four substantially identical passageways, two each in the visible face of each leaf, are formed by a circular hole in the face in combination with a ferrule or eyelet, such as eyelets 220, which are staked in place over the circular hole. The knuckle area of data transfer hinge 200 is shown in a cut away view in FIG. 2, and includes four identical nylon spacers 222, and two pins 224, each having a void inside through which wires may pass. Such pins may also be referred to as being hollow or as hollow pins. Two twisted pairs of data wires are contained in jackets 226 and 228 of FIG. 2. Four straight wires and a ground wire are contained in jackets 230 and 232 of FIG. 2. The jackets can be formed with heat shrink tubing. Although the data transfer hinge will operate properly in at least some environments with no shielding over the twisted pairs, signal integrity may be improved if shielding is provided, which can be accomplished by using shielded heat shrink tubing for jackets 226 and 228. The shield can be either terminated or left floating.

Staying with FIG. 2, identical solid lines through channels 207 and 211, as well as two of the nylon spacers 222 and the top hollow pin illustrate the path of each twisted pair of data wires. Each twisted pair passes from a channel, through a hole into one of the nylon spacers 222, through one of the hollow pins 224, into another one of the nylon spacers 222 and through a hole in the nylon spacer back into a channel. Each twisted pair passes through an eyelet 220 in each leaf and back into jacketing. Similarly, a thin solid line illustrates the path of two of the straight through wires through channels 208 and 212, as well as two of nylon spacers 222 and one of hollow pins 224. A thick solid line illustrates the path of two of the straight through wires plus the ground wire through channels 209 and 213, as well as two of nylon spacers 222 and one of hollow pins 224. Plugs 240 hold the hinge leaves, pins and spacers together as well as provide for a suitable appearance of the hinge. It should be noted that portions of the channels between leaf edges 210 and 214 and the passageways into the hinge leaves are unused, and exist in this embodiment because the channels are made by boring with a bit through the hinge leaf from one edge to the other, in a direction parallel to the face.

Figure 3:
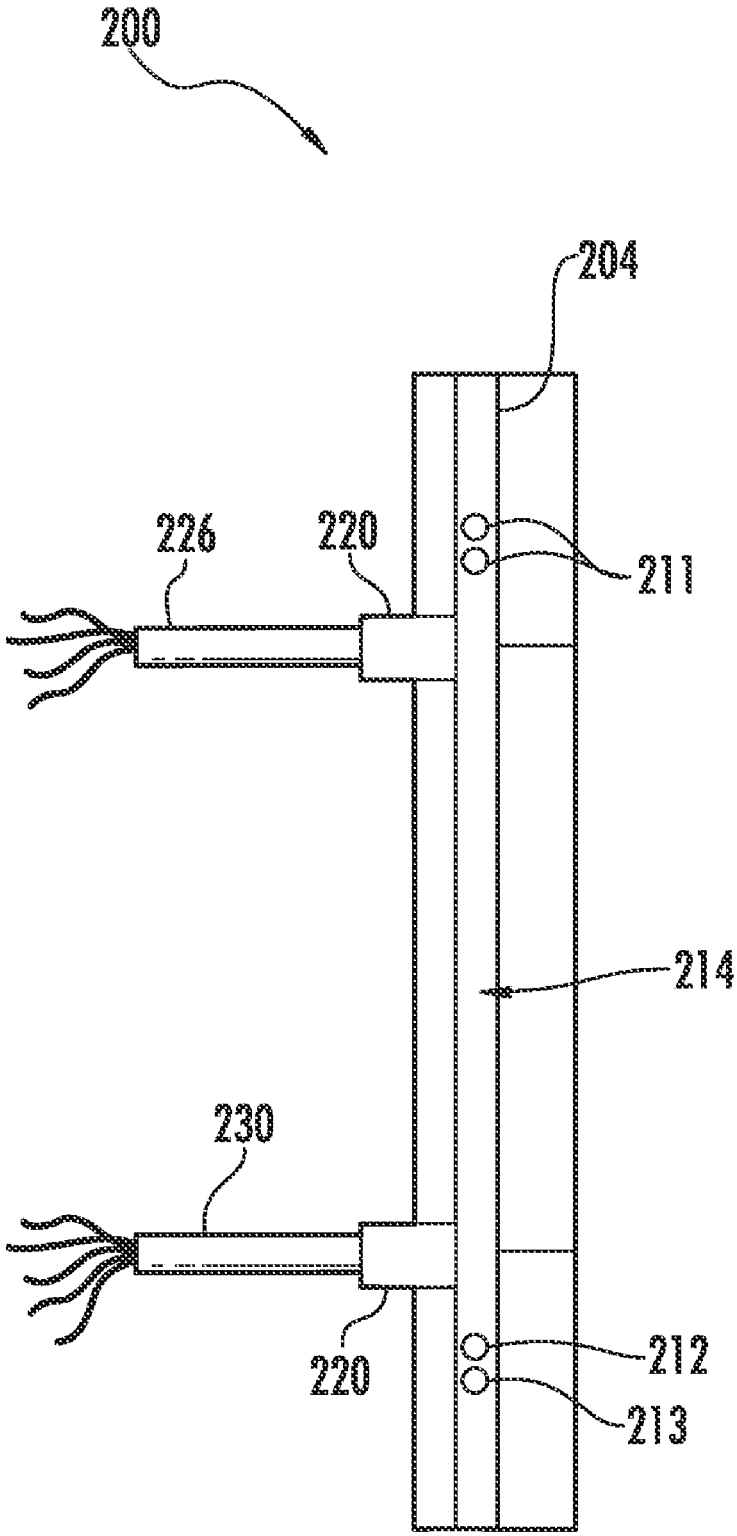

FIG. 3 shows a side view of data transfer hinge 200 wherein edge 214 of leaf 204 faces the viewer. Cable jackets 226 and 230, as well as two of the eyelets 220, are also visible. The ends of channels 211, 212 and 213 are visible in edge 214 of leaf 204. Since the portions of the channels close to edge 214 are unused, the holes formed by the channels can be plugged with epoxy or a similar compound to protect the wiring inside the channels.

Figure 4:
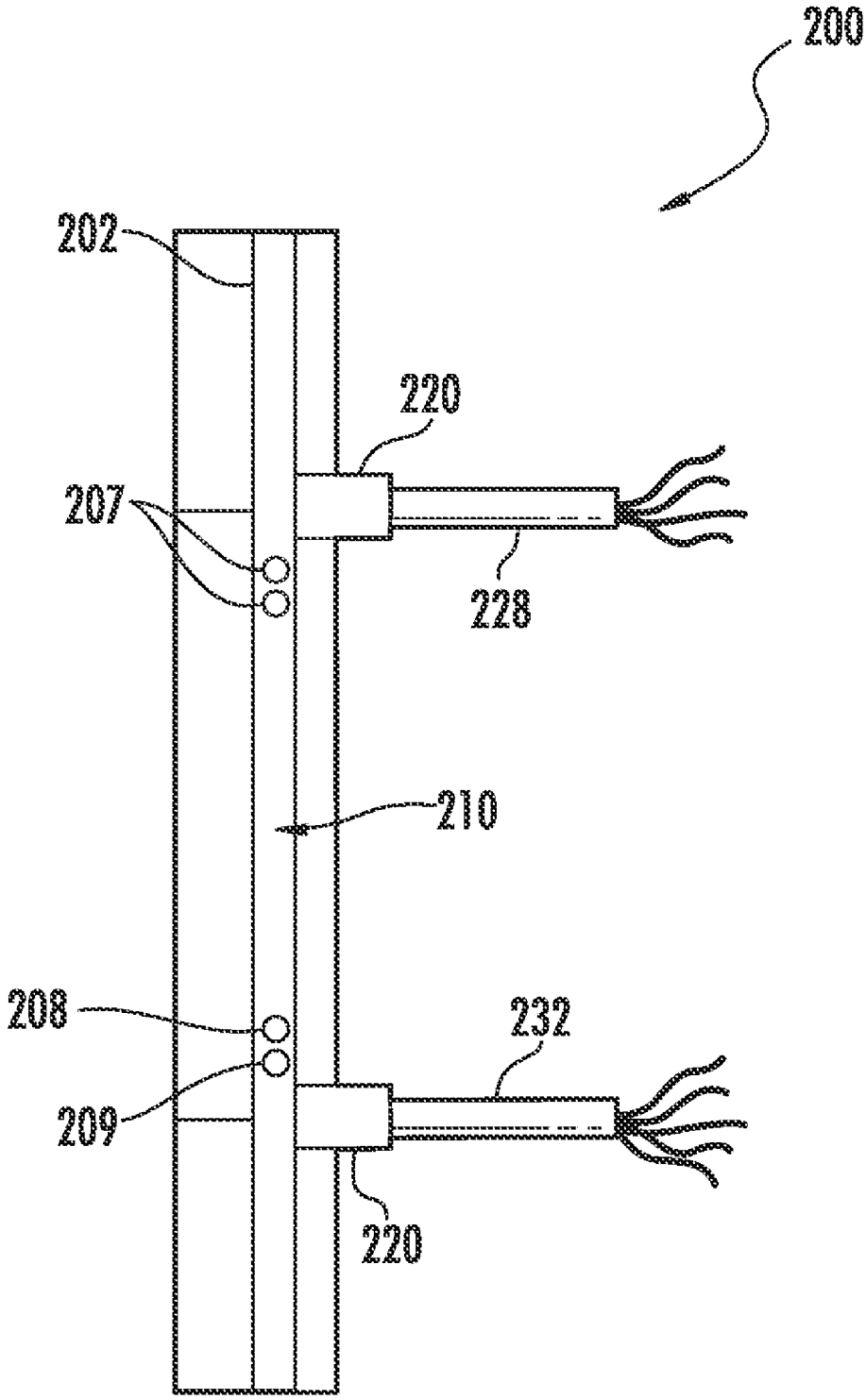

FIG. 4 shows a view of the other side of data transfer hinge 200 wherein edge 210 of leaf 202 faces the viewer. Cable jackets 228 and 232, as well as two of the eyelets 220, are also visible. The ends of channels 207, 208 and 209 are visible in edge 210 of leaf 202. Again, since the portions of the channels close to edge 210 are unused, the holes formed by the channels can be plugged with epoxy or a similar compound to protect the wiring inside the channels.

Figure 5:
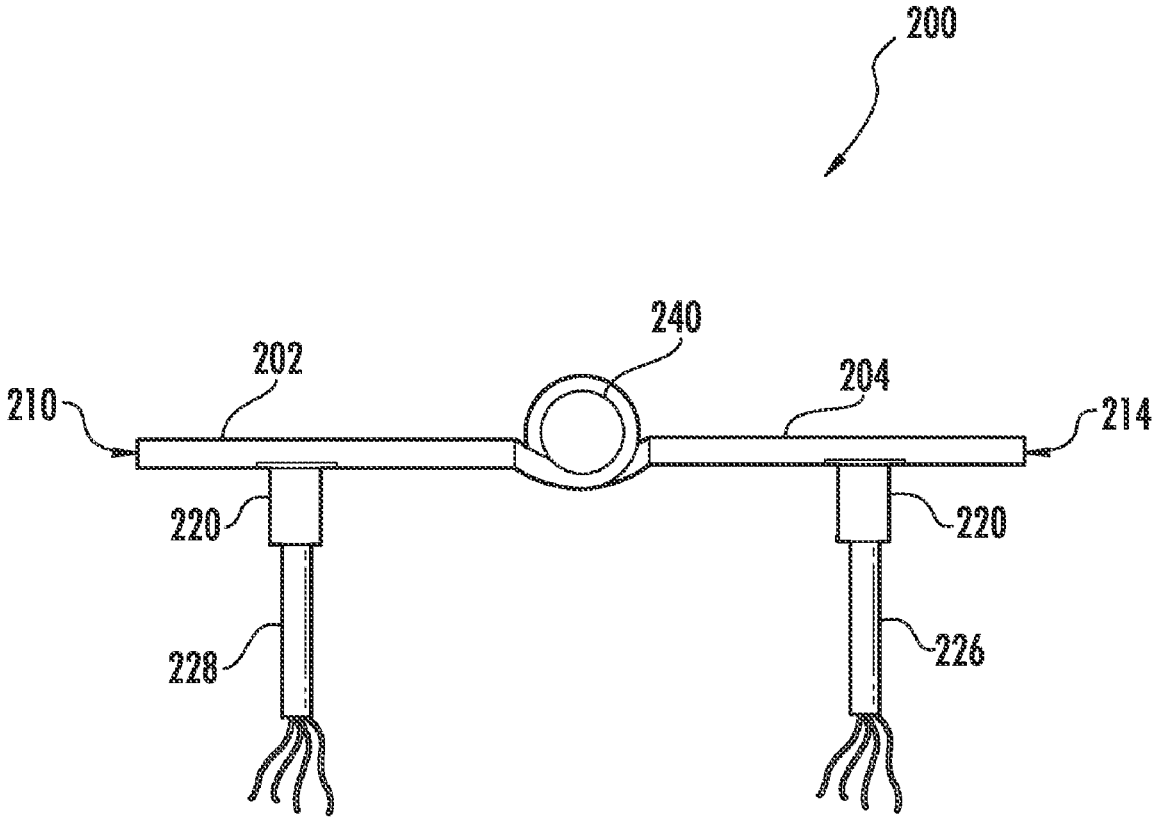

FIG. 5 shows a top view of data transfer hinge 200 wherein the tops of leaves 202 and 204 are each visible. Edges 210 and 214 are also indicated. Cable jackets 226 and 228, as well as two of the eyelets 220, are also visible. The top plug of the two plugs, 240, is also visible.

As previously mentioned, each wire of the twisted pairs of data wires is of a gauge and has insulation of a specified thickness and permittivity so as to cooperate with the channel in the hinge leaves to maintain an even distribution of capacitance and appropriate impedance for connection within a local area network. The appropriate impedance can be maintained despite varying electrical potential of the hinge body. In example embodiments, this impedance is approximately 100 ohms at 100 MHz. Either stranded or solid wire can be used in the hinge, for both the twisted data pairs of wires and the straight wires. Twisting at a specified number of twists per unit length contributes to maintaining signal integrity and preventing excessive capacitive coupling to ground or between wires. At least many of these characteristics interact to determine the impedance characteristics of the hinge. If any one of these parameters are varied, others can be adjusted to compensate. Shielding of the portion of the twisted pairs is optional, but can improve signal integrity. The ground wire running through the hinge can be included to provide ESD protection for connected devices.

Strip-line assumptions can be used for initial calculations to set the parameters of a data transfer hinge according to example embodiments of the invention. Trial and error can then be used together with empirical testing to design a hinge. Assuming the hinge is to be used in an Ethernet LAN, standard Ethernet compliance test parameter evaluation procedures can be used to verify and adjust the design when varying parameters such as the channel size and shape, wire gauge, type and amount of insulation, etc.

The following specific design parameters have been found to produce a data transfer hinge like that shown in FIGS. 2-5 with a stable impedance of the data pairs of 100 ohms at 100 MHz useful for passing 100 megabit per second Ethernet traffic. Stranded, insulated wire of gauge 26AWG is used for the data pairs, and stranded, insulated wire of gauge 28AWG is used for the straight wires, except for the ground wire, which is stranded insulated wire of gauge 22AWG in this example. Each twisted pair is twisted at a rate of about 1.5 twists per inch throughout the hinge and insulating jackets, until within 0.75 inches or less from each connector. Rates from about 1.3 to about 1.9 twists per inch have been found to work in a hinge like that shown in FIGS. 2-5. The channels are machined by boring holes through the hinge leaves using a two millimeter bit. With these parameters, the insulation on the wires should have a permittivity of approximately 2.1. Insulation used in an example Ethernet data transfer hinge is either tetrafluoroethene (TFE) or polytetrafluoroethene (PTFE) with a thickness of about 0.006 inches (6 mils). Such insulation can be used on the straight wires as well as the twisted pair wires for convenience.

It should be noted that the term "twists per inch" or indeed, twists per any unit length, may have different meanings. The figure is sometimes used to represent the number of turns or "waves" of a single wire of the twisted pair per unit length of the pair. Alternatively, the figure sometimes refers to the number of times per unit length that the two wires cross. It is the former meaning that is intended here. The same physical twisted pair of wires that is described herein as having about 1.5 twists per inch could also be described as having about 3 twists per inch if the latter meaning is understood.

As previously mentioned, wire insulation can be used to impart color coding to the individual wires in accordance with a wiring standard. For example, wire insulation colors for compliance with the Ethernet TIA-EIA-568B wiring standard can be used so that the eight wires running through the hinge in the examples presented herein match the eight wire colors used in that standard. In such a case, the wires of one of the twisted pairs would appear green, and white/green. The wires of the other twisted pair would appear orange and white/orange. The straight wires through the hinge would appear brown, white/brown, blue and white/blue. For the ground wire in example embodiments, since it is not specified in the standard, any color insulation can be used, for example, green, or green with a yellow stripe.

The two jackets leaving a leaf of the hinge could be brought close together and the wires connected to a standard LAN connector such as a male or female RJ-45 connector used in Ethernet systems. Alternatively, the wires emerging from each jacket could be terminated in a connector, making for two connectors to the hinge in the door and two connectors to the hinge in the door frame. For example, four-pin Molex™ connectors could be used for the twisted pairs, and six-pin Molex connectors could be used for the four straight wires and the ground, with one pin unused (as pictured schematically in FIG. 1). In this case, wiring harnesses for the door and door frame with mating Molex connectors can be provided where the hinge is installed. With either connector scheme, an Ethernet version of the data transfer hinge can be used in a power-over-Ethernet (POE) environment, with power being supplied to a door-mounted device or devices either through the straight wires, the twisted pairs, or both. A data transfer hinge can also be supplied with flying leads, in which case any connector used would be installed in the field.

Figure 6:
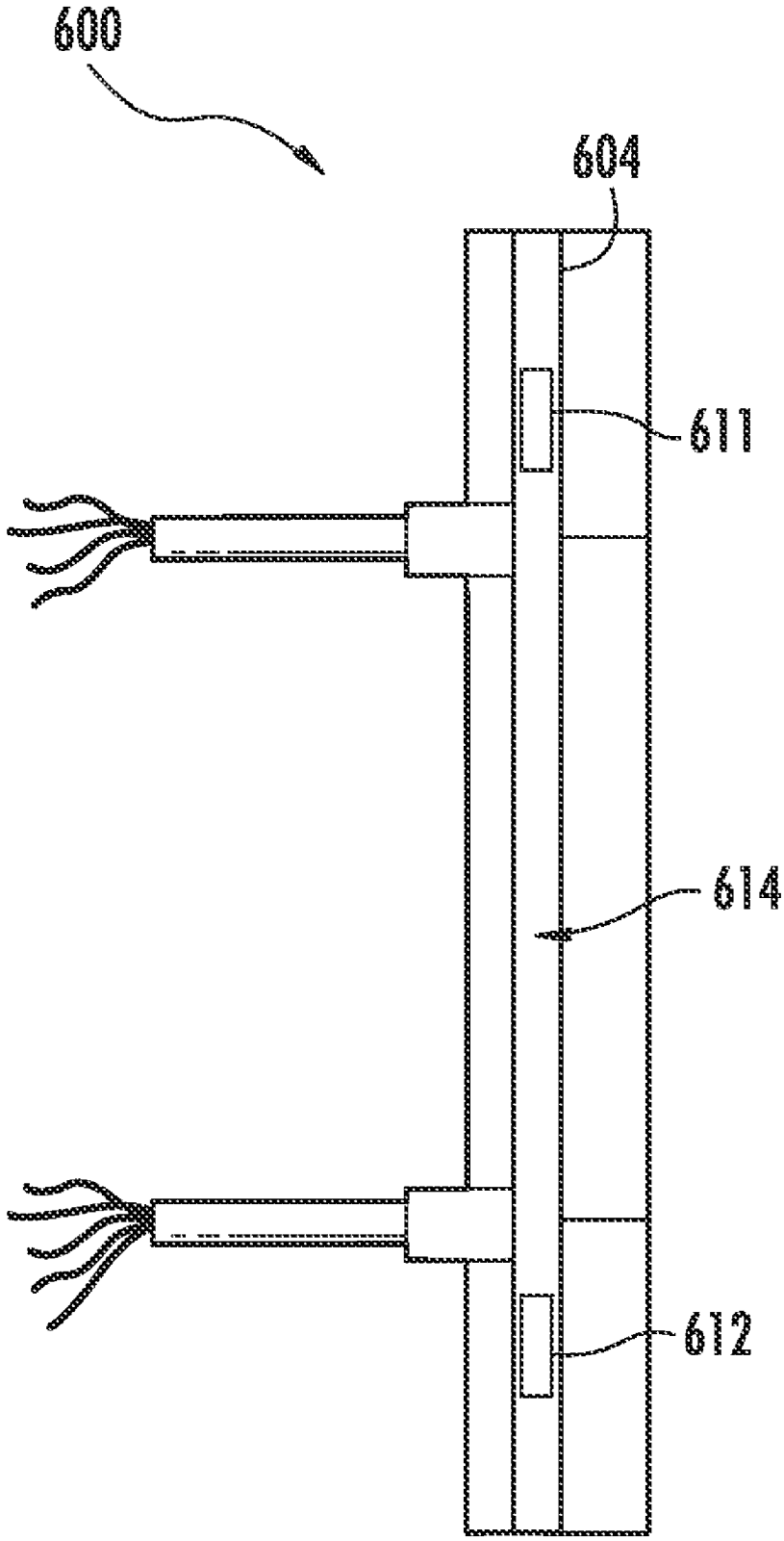
FIGS. 6 and 7 present more accurate, side views of another embodiment of the data transfer hinge of the present invention.
Figure 7:
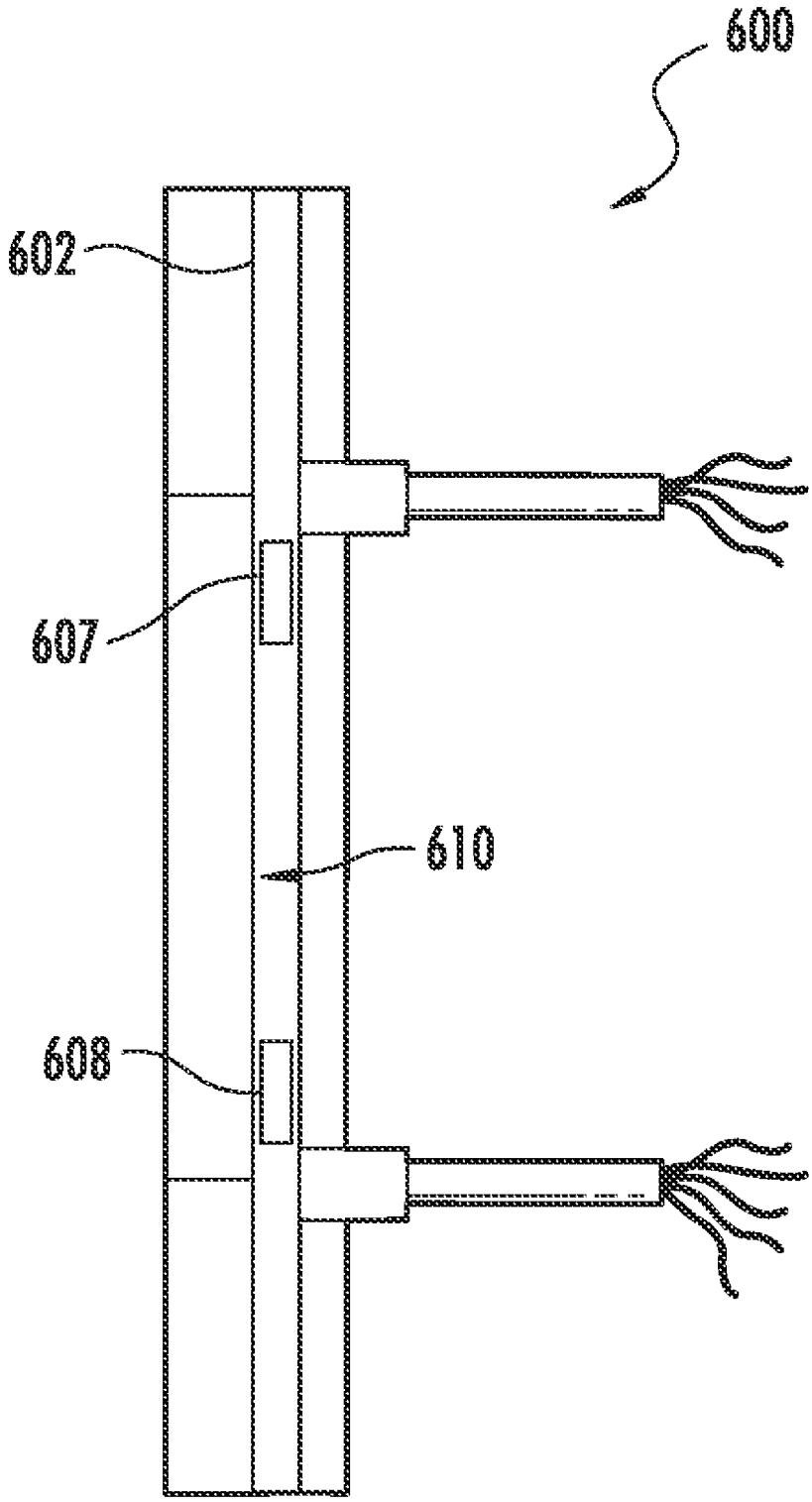

FIGS. 6 and 7 illustrate another embodiment of the data transfer hinge. In this embodiment, the channels take the form of slots made with electrical discharge machining (EDM). Since the slot openings are long and rectangular, two twisted wire pairs are run though one channel (slot) in each leaf and all of the straight wires and the ground wire are run through another channel (slot). In other respects, the external appearance of this embodiment of the data transfer hinge does not differ substantially from the embodiment shown in FIGS. 2-5. FIG. 6 is a side view of data transfer hinge 600 wherein edge 614 of leaf 604 faces the viewer. Cable jackets and eyelets are also visible as before. The ends of EDM formed slot shaped channels 611 and 612 are visible in edge 614 of leaf 604. Since, as before, the portions of the channels close to edge 614 are unused, the openings formed by the slots can be plugged with epoxy or a similar compound to protect the wiring inside.

FIG. 7 shows a view of the other side of data transfer hinge 600 wherein edge 610 of leaf 602 faces the viewer. Cable jackets and eyelets are also visible as before. The ends of EDM formed slot shaped channels 607 and 608 are visible in edge 610 of leaf 602. Again, since the portions of the channels close to edge 610 are unused, the holes formed by the channels can be plugged with epoxy or a similar compound to protect the wiring. The top view and any facial views of the data transfer hinge embodiment of FIGS. 6 and 7 would appear substantially the same as views of the previously described embodiment, save for the dotted lines shown in FIG. 2, which would outline only a single channel corresponding to each passageway in the face of a leaf.

It should be noted that an embodiment of the data transfer hinge could be developed that relied on a combination of machining methods for forming the channels needed for the various wires. For example, one or more channels could be bored and one or more could be formed by using EDM. It may also be possible to produce an embodiment with a single channel and/or passageway for each leaf of the hinge where all wires pass, for example, by forming one slot in each leaf using EDM. In any such case, the various other design parameters previously discussed can be varied to achieve an appropriate impedance so that the hinge can be used to pass LAN traffic.

Figure 8:
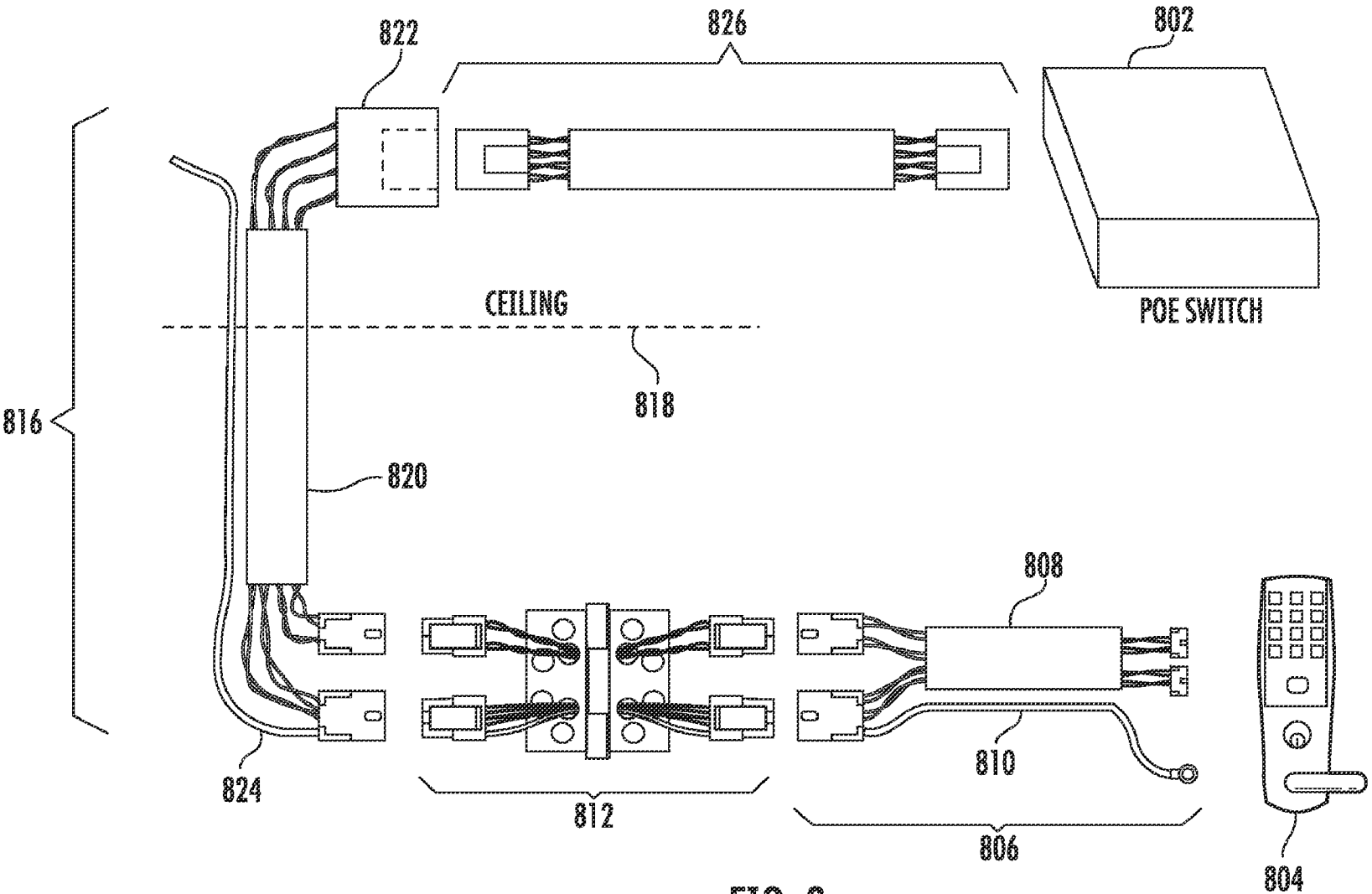
FIG. 8 is a system block diagram that illustrates an example installation environment of the data transfer hinge.

FIG. 8 is a system block diagram that shows an example installation environment for an embodiment of the data transfer hinge. In this example, the hinge is used in an Ethernet network within a building. This network supports POE. In FIG. 8, the data transfer hinge forms part of the signal path from POE switch 802 to POE lockset 804. Door harness assembly 806 is positioned inside the door on which lockset 804 is mounted. Door harness assembly 806 includes a run of category 5*e* shielded, screened, Ethernet cable 808, and earth ground wire 810, as well appropriate connectors to mate with lockset 804 on one end and data transfer hinge 812 on the other end. Data transfer hinge 812 in FIG. 8 is an example embodiment of the data transfer hinge as heretofore discussed.

Still referring to FIG. 8, door frame harness assembly 816 connects data transfer hinge 812 to the building wiring, through a door frame. In this example, door frame harness assembly 816 passes through ceiling 818 to interface with typical Ethernet cabling. In this example, door frame harness assembly 816 includes a run of approximately fifteen feet of category 5*e* shielded, screened, Ethernet cable 820, with appropriate connectors for the data transfer hinge on the end that is positioned in the door frame. The end of the cable in the ceiling is fitted with a standard, female RJ-45 connector, 822. As with the door harness assembly, a separate, single conductor 824 is provided for earth ground. Cable 826 is an existing building cable with standard RJ-45 connectors on each end. Cable 826 connects door frame harness assembly 816 with POE switch 802.

It should be noted that the cabling and connectors shown in FIG. 8 can be varied and may be supplied and used in many different ways. For example, wiring harnesses can be assembled in the field from off-the-shelf parts, custom parts, or kits. Different types of connectors can be used. The installation shown in FIG. 8 is intended to be a representative example only.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" or "more", are intended to encompass the concept of equality, thus, "less" can mean not only "less" in the strictest mathematical sense, but also, "less than or equal to."

It should also pointed out that references made in this disclosure to figures and descriptions using positional terms such as, but not limited to, "top" and "bottom" refer only to the relative position of features as shown from the perspective of the reader. Such term are not meant to imply any absolute positions. An element can be functionally in the same place in an actual product, even though one might refer to the position of the element differently due to the instant orientation of the device.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A data transfer hinge comprising:

a first leaf and a second leaf, each having at least one knuckle, at least one channel running from an edge coincident with the at least one knuckle, and a passageway in a face thereof opening into the at least one channel, the at least one knuckle of the first leaf and the at least one knuckle of the second leaf being arranged to be relatively rotatable around a common axis; and a twisted pair of data wires having a specified number of twists per unit length, the twisted pair of data wires running through the passageway in the face of each leaf and through the at least one channel in both the first leaf and the second leaf, wherein each wire of the twisted pair of data wires is of a gauge and has insulation of a specified thickness and permittivity so as to cooperate with the channel to maintain an even distribution of capacitance and an appropriate impedance for connection within a local area network.

2. The data transfer hinge of claim 1 wherein the at least one channel comprises a plurality of channels, and wherein the data transfer hinge comprises two twisted pairs of data wires running through the passageway in each leaf, each twisted pair of data wires also running through one of the plurality of channels.

3. The data transfer hinge of claim 2 further comprising:

an additional passageway in each leaf opening into at least some of the plurality of channels;

at least one additional wire for at least one of power and ground running through the additional passageway in each leaf and at least one of the plurality of channels; and connectors on each end of the two twisted pairs of data wires and the at least one additional wire.

4. The data transfer hinge of claim 2 further comprising a pin having a void though which the two twisted pairs of data wires pass, and wherein the at least one knuckle of the first leaf and the at least one knuckle of the second leaf are arranged to receive the pin.

5. The data transfer hinge of claim 3 further comprising shielding covering at least a portion of the two twisted pairs of data wires that extend outside of the passageway in each leaf.

6. The data transfer hinge of claim 3 wherein the specified number of twists per unit length of the twisted pairs of data wires is about 1.5 twists per inch.

7. The data transfer hinge of claim 6 wherein the gauge of the data wires is 26AWG and each of the plurality of channels is machined by boring with a 2 millimeter bit.

8. The data transfer hinge of claim 7 wherein the specified thickness of the insulation is about 0.006 inches and the permittivity of the insulation is about 2.1.

9. The data transfer hinge of claim 5 wherein the specified number of twists per unit length of the twisted pairs of data wires is about 1.5 twists per inch.

10. The data transfer hinge of claim 9 wherein the gauge of the data wires is 26AWG and each of the plurality of channels is machined by boring with a 2 millimeter bit.

11. The data transfer hinge of claim 10 wherein the specified thickness of the insulation is about 0.006 inches and the permittivity of the insulation is about 2.1.

12. The data transfer hinge of claim 1 wherein the at least one channel comprises a first slot, and wherein the data transfer hinge comprises two twisted pairs of data wires running through the passageway in each leaf, each twisted pair of data wires also running through the first slot.

13. The data transfer hinge of claim 12 further comprising:

an additional passageway in each leaf opening into a second slot;

at least one additional wire for at least one of power and ground running through the additional passageway in each leaf and the second slot; and connectors on each end of the two twisted pairs of data wires and the at least one additional wire.

14. A method of constructing a data transfer hinge comprising:

providing a first leaf and a second leaf, each having at least one knuckle, the at least one knuckle of the first leaf and the at least one knuckle of the second leaf being arranged to be relatively rotatable around a common axis when the first leaf and the second leaf are joined;

creating at least a first passageway in a face of each of the first leaf and the second leaf;

machining at least one channel in each of the first leaf and the second leaf running from an edge coincident with the at least one knuckle to at least the first passage way in the face;

joining the first leaf and the second leaf to form a hinge; and running two twisted pairs of data wires having a specified number of twists per unit length through the first passageway in the face of each leaf and further running at least one of the two twisted pairs through the at least one channel in both the first leaf and the second leaf, wherein each wire of the twisted pairs of data wires is of a gauge and has insulation of a specified thickness and permittivity so as to cooperate with the at least one channel to maintain an even distribution of capacitance and an appropriate impedance for connection within a local area network.

15. The method of claim 14 wherein the joining of the first leaf and the second leaf is accomplished using at least one pin having a void though which the two twisted pairs of data wires pass, and wherein the at least one knuckle of the first leaf and the at least one knuckle of the second leaf are arranged to receive the at least one pin.

16. The method of claim 15 further comprising:

forming a second passage way in the face of each leaf of the first and second leaves; and running at least one additional wire for at least one of power and ground through the second passageway in the face of each of the first leaf and the second leaf and the at least one channel, as well as through a second pin having a void.

17. The method of claim 14 further comprising:

shielding at least a portion of the two twisted pairs of data wires that extend outside of the first passageway in each leaf; and attaching a connector to each end of the two twisted pairs of data wires.

18. The method of claim 17 wherein the specified number of twists per unit length of the twisted pairs of data wires is about 1.5 twists per inch.

19. The method of claim 18 wherein the gauge of the data wires is 26AWG and the at least one channel is machined by boring with a 2 millimeter bit.

20. The method of claim 19 wherein the specified thickness of the insulation is about 0.006 inches and the permittivity of the insulation is about 2.1.

21. The method of claim 16 further comprising shielding at least a portion of the two twisted pairs of data wires that extend outside of the first passageway in each leaf; and attaching connectors to each end of the two twisted pairs of data wires and to each end of the at least one additional wire.

22. The method of claim 21 wherein the specified number of twists per unit length of the twisted pairs of data wires is about 1.5 twists per inch.

23. The method of claim 22 wherein the gauge of the data wires is 26AWG and the at least one channel is machined by boring with a 2 millimeter bit.

24. The method of claim 23 wherein the specified thickness of the insulation is about 0.006 inches and the permittivity of the insulation is about 2.1.

25. The method of claim 17, wherein the at least one channel is machined with electrical discharge machining.

26. A data transfer hinge comprising:

first and second leaves;

means for joining the first and second leaves to be rotatable relative to each other around a common axis;

means for carrying local area network signals between the first leaf of the data transfer hinge and the second leaf of the data transfer hinge while maintaining an even distribution of capacitance and an appropriate impedance for connection within a local area network; and means for connecting the data transfer hinge to the local area network.

27. The data transfer hinge of claim 26 further comprising means for carrying power and ground between the first leaf of the data transfer and the second leaf of the data transfer hinge.

* * * * *